United States Patent [19]

Josefek

[11] Patent Number: 4,506,929

[45] Date of Patent: Mar. 26, 1985

[54] LUMBAR RIDGE SUPPORTING

[76] Inventor: Kirt L. Josefek, 344 Union Ave., Framingham, Mass. 01701

[21] Appl. No.: 401,743

[22] Filed: Jul. 26, 1982

[51] Int. Cl.[3] ..... A47C 7/02

[52] U.S. Cl. ..... 297/230; 297/460

[58] Field of Search ..... 297/460, 230, 231, 284, 297/DIG. 3

[56] References Cited

U.S. PATENT DOCUMENTS

| | | | |
|---|---|---|---|
| 1,917,264 | 7/1933 | Kellogg | 297/460 |
| 2,591,306 | 4/1952 | Sherman | 297/230 |
| 2,769,485 | 11/1956 | Shapiro | 297/460 |
| 2,853,122 | 9/1958 | Shapiro | 297/460 |
| 2,970,638 | 2/1961 | Halter | 297/460 |
| 3,765,721 | 10/1973 | Watkin | 297/460 |
| 4,097,087 | 6/1978 | Garavaglia | 297/231 |
| 4,339,150 | 7/1982 | McNamara | 297/460 |

*Primary Examiner*—Francis K. Zugel

*Attorney, Agent, or Firm*—Joseph S. Iandiorio

[57] ABSTRACT

A covered cushion about 15" wide and 13" high of injection foam material is formed convexly in the vertical plane with a central lumbar ridge about 2 3/16" wide and slightly less than an inch thick. The top of the cover carries a handle, and the back of the cover is formed with an opening for allowing admission and removal of the cushion.

1 Claim, 8 Drawing Figures

LUMBAR RIDGE SUPPORTING

The present invention relates in general to back supporting and more particularly concerns novel apparatus and techniques for comfortably supporting the lower lumbar region groove that extends vertically from the base of the spine.

Various forms of back cuchions are available. For example, one commercially available cushion is curved convexly vertically and concavely horizontally for providing support in the lower back region. Another prior art cushion has a seat and back that is curved convexly in the vertical plane and essentially straight in the horizontal plane with means for adjusting the height of the back and the degree of convex curvature.

A search of subclasses 337, 338 and 355 of class 5 and subclass 460 of class 297 uncovered the following U.S. patents: U.S. Pat. Nos. 2,244,440; 3,197,255; 3,361,471; 3,145,054; 3,348,880; 3,765,721. None of this prior art recognizes the importance of supporting the precise spine to allow the muscles to maintain normal lordodic curvature and thereby provide improved support.

There are spinous and transverse processes which are projections of vertebrae for attaching muscles. These muscles ordinarily maintain a normal lordodic curvature in lumbar spine that is altered when one sits against a backrest that is essentially smooth in the horizontal plane. Prior art seat backs and support cushions do not allow the muscles to promote the normal lordodic curvature on the precise spine.

Accordingly, it is an important object of this invention to provide an improved back support.

It is a further object of the invention to achieve the preceding object while allowing the muscles to maintain normal lordodic curvature and provide improved support.

It is still another object of the invention to achieve one or more of the preceding objects with a support that is capable of providing support to a wide range of people.

It is still another object of the invention to achieve one or more of the preceding objects with structure that is relatively easy and convenient to carry so that it may be used in virtually any seat.

According to the invention, there is cushioning means that is convexly curved and formed with a centrally located vertically extending lumbar ridge for mating engagement within the recess established as the muscles attached to the bilateral transverse processes maintain normal lordodic curvature of the precise spine. Typically this lumbar ridge is slightly less than an inch thick and is typically 2 3/16" wide and may be slightly wider or narrower and is preferably formed with rounded corners. The lumbar spine height is typically 10–12" for virtually all adults and a cushion height of about 13" accommodates this region. A feature of the invention is a handle secured to the top to facilitate transporting it. The invention is preferably made of a resilient material by an injection foam process known in the art to accommodate the spine structure.

Numerous other features, objects and advantages of the invention will become apparent from the following specification when read in connection with the accompanying drawing in which.

Figure 2:
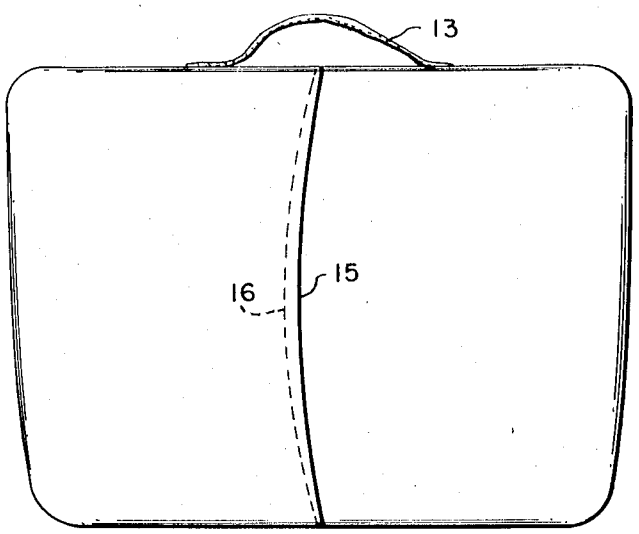
FIG. 2 is a plan view of the embodiment of FIG. 1 from the opposite side.
Figure 1:
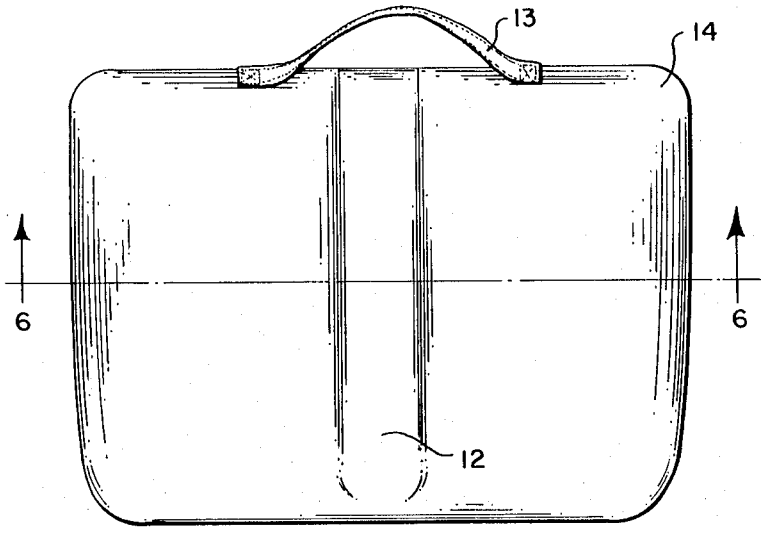
FIG. 1 is a plan view of an embodiment of the invention showing the lumbar supporting region.

With reference now to the drawing and more particularly FIG. 1 thereof, there is shown a plan view of a cushion 11 according to the invention formed with a vertically extending centrally located lumbar support ridge 12 and having a handle 13 sewed to the top of cushion cover 14. FIG. 2 is a view of the covered cushion of FIG. 1 from the opposite side, showing the overlapping edges 15 and 16 that define a slot through which the cushion may enter and exit to facilitate washing the cover and/or replacing either cushion or cover.

Figure 4:
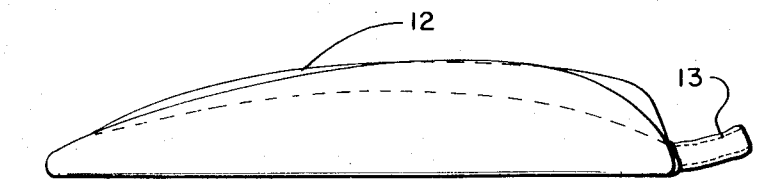
FIG. 4 is a side view of the embodiment.
Figure 3:
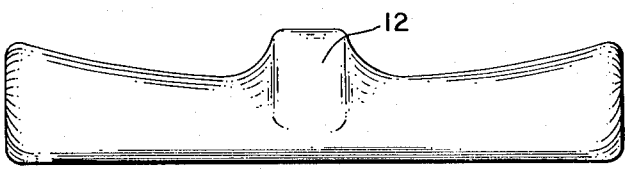
FIG. 3 is a bottom view of the embodiment.

Referring to FIG. 3, there is shown a bottom view of the covered cushion showing the generally flat but slightly horizontally concavely curved wing portions on either side of the centrally located lumbar ridge 12. FIG. 4 is a side view of the covered cushion showing the convex curvature vertically.

Figure 5:
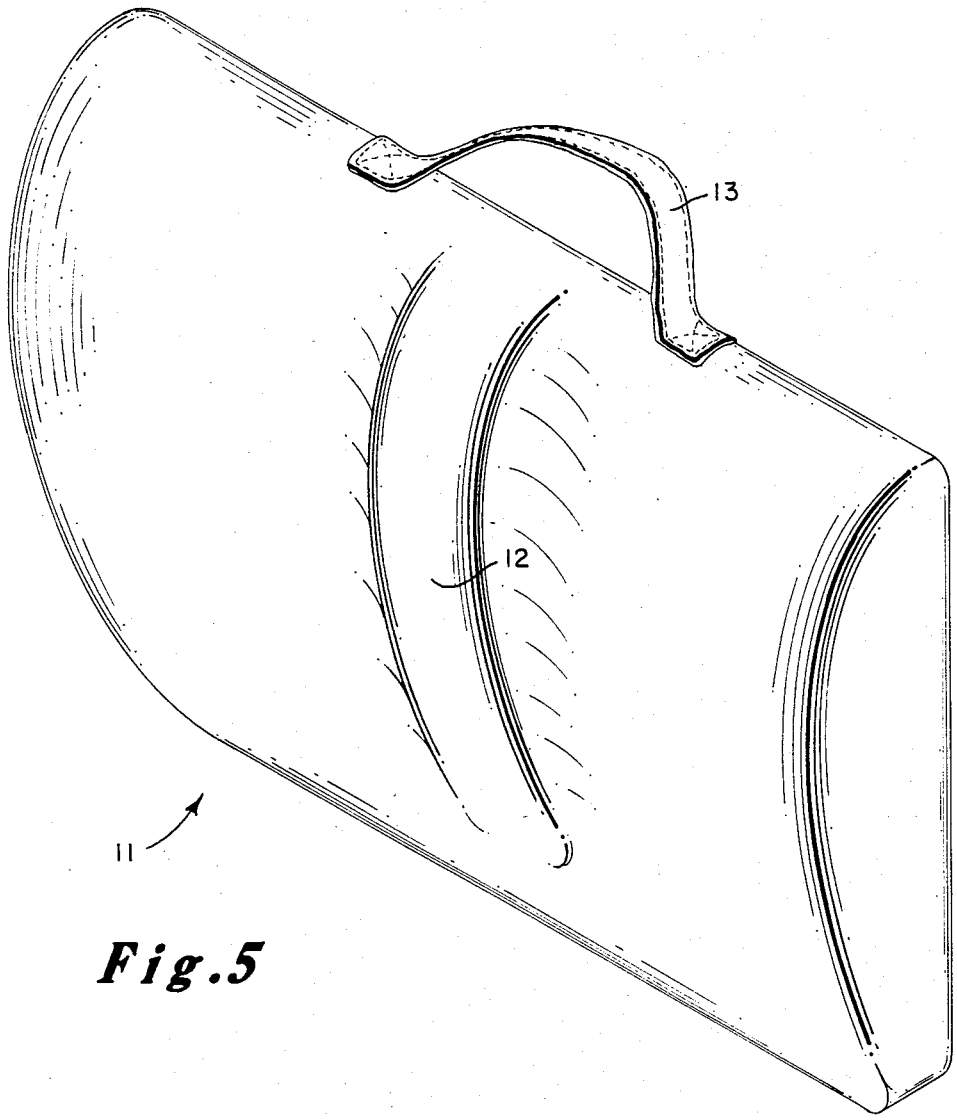
FIG. 5 is a perspective view of the embodiment of the invention.

Referring to FIG. 5, there is shown a perspective view of the covered cushion according to the invention.

Figure 6:
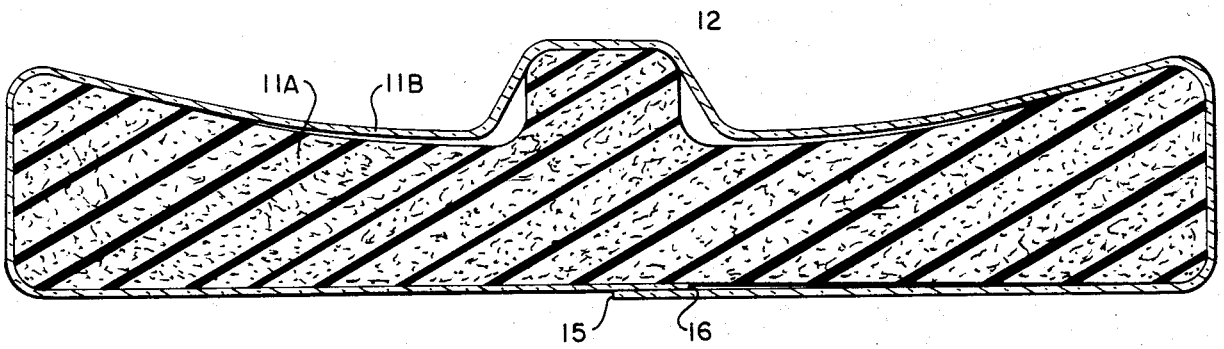
FIG. 6 is a sectional view through section 6—6 of FIG. 1.

Referring to FIG. 6, there is shown a view through section 6—6 of FIG. 1 showing the foam cushion 11A inside the cloth cover 11B.

Figure 7:
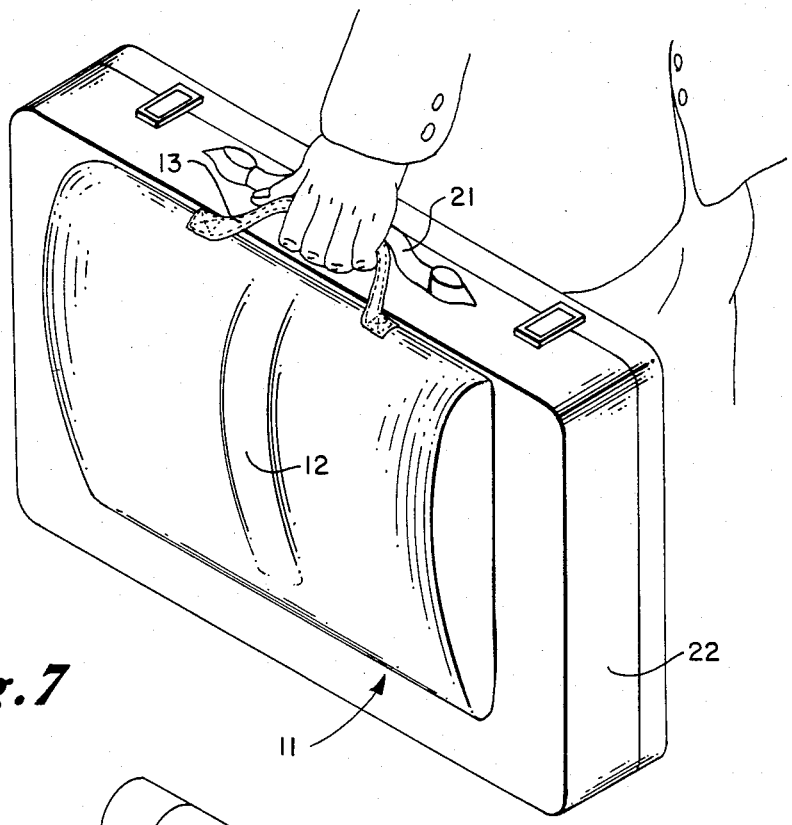
FIG. 7 is a perspective view of the invention being held by the same hand carrying an adjacent attache case.

Referring to FIG. 7, there is shown a view of the covered cushion conveniently carried in one hand that grasps both handle 13 and handle 21 of attache case 22. A user may thus carry cushion 11 wherever the user goes.

Figure 8:
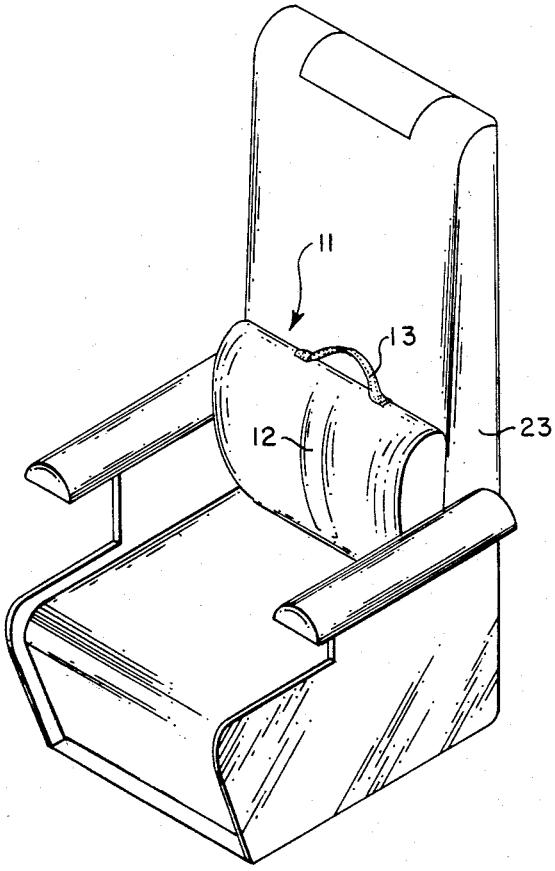
FIG. 8 is a perspective view of the invention located in a vehicle seat.

Referring to FIG. 8, there is shown a perspective view of cushion 11 located in a vehicle seat 23, such as an aircraft seat.

In a specific embodiment of the invention the cushion width was 15½" wide, 13⅛" high and 3" thick at the thickest edge points. Lumbar ridge 12 was 2⅜" wide at the base, slightly less than 2" wide at the back contacting surface, slightly less than 12" high and slightly less than an inch thick.

The user typically places cushion 11 on a seat as shown in FIG. 8. The user's back engages the cushion so that ridge 12 is received in the spinal channel which is centrally disposed in and extends vertically along the lumbar area of the back. This channel is formed due to the muscles attached to the vertebrae and projections therefrom maintaining a normal lordodic (e.g. forward) curvature of the lumbar portion of the spine. This typically occurs in the standing position. The mating engagement of ridge 12 within the spinal channel provides lumbar support which enables the muscles to maintain their normal lordodic curvature in the seated position.

The cushion provides both comfort and support to a user, is compact and lightweight and easy to transport with the user. It is apparent that those skilled in the art may now make numerous uses and modifications of and departures from the specific embodiments and techniques disclosed herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. A lumbar support cushion comprising a resilient material approximately thirteen inches high and having a generally convex curvature in the vertical direction and a generally concave curvature in the horizontal direction, and lumbar ridge means disposed centrally in said cushion and extending vertically from just above the base of the cushion to the top of the cushion for mating engagement within the lumbar spinal recess formed by the muscles attached to the bilateral transverse processes of the precise spine for providing lumbar support which allows the muscles to maintain normal lordodic curvature, said lumbar ridge means being approximately two inches wide and twelve inches high and having a generally convex curvature in both the vertical and horizontal directions.

* * * * *